US006732464B2

(12) United States Patent
Kurvinen

(10) Patent No.: US 6,732,464 B2
(45) Date of Patent: May 11, 2004

(54) DISCHARGING DEVICE

(76) Inventor: Ilmo Kurvinen, Mattisenlahdentie 32, FIN-80400 Ylämylly (FI)

( * ) Notice: Subject to any disclaimer, the term of this patent is extended or adjusted under 35 U.S.C. 154(b) by 0 days.

(21) Appl. No.: 10/138,663

(22) Filed: May 6, 2002

(65) Prior Publication Data

US 2002/0129532 A1 Sep. 19, 2002

Related U.S. Application Data

(63) Continuation of application No. 09/805,433, filed on Mar. 14, 2001, now abandoned, which is a continuation of application No. PCT/FI99/00766, filed on Sep. 17, 1999.

(30) Foreign Application Priority Data

Sep. 17, 1998 (FI) ..... 982006

(51) Int. Cl.[7] ..... F41A 19/00
(52) U.S. Cl. ..... 42/69.01; 42/84; 89/28.1
(58) Field of Search ..... 42/69.01, 84; 89/28.1

(56) References Cited

U.S. PATENT DOCUMENTS

| | | | | |
|---|---|---|---|---|
| 2,424,247 A | | 7/1947 | McCaslin | |
| 3,703,845 A | * | 11/1972 | Griew | 89/134 |
| 4,009,536 A | | 3/1977 | Wolff | |
| 4,019,273 A | | 4/1977 | Kibler et al. | 42/1 |
| 4,134,223 A | | 1/1979 | Hillenrandt et al. | 42/84 |
| 4,275,521 A | | 6/1981 | Gerstenberger | |
| 4,347,679 A | | 9/1982 | Grunig et al. | 42/84 |
| 4,440,063 A | * | 4/1984 | Zangrando | 89/135 |
| 4,510,844 A | * | 4/1985 | Fritz et al. | 89/129.02 |
| 4,793,085 A | | 12/1988 | Surawski et al. | 42/84 |
| 5,074,189 A | | 12/1991 | Kurtz | 89/135 |
| 5,272,828 A | | 12/1993 | Petrick et al. | 42/84 |
| 5,303,495 A | | 4/1994 | Harthcock | 42/84 |
| 5,569,085 A | * | 10/1996 | Igarashi et al. | 463/49 |
| 5,636,464 A | * | 6/1997 | Ciluffo | 42/70.11 |
| 5,755,056 A | | 5/1998 | Danner et al. | 42/84 |
| 6,321,478 B1 | * | 11/2001 | Klebes | 42/84 |
| 6,397,508 B1 | * | 6/2002 | Constant et al. | 42/69.01 |
| 6,425,199 B1 | * | 7/2002 | Vaid et al. | 42/84 |

FOREIGN PATENT DOCUMENTS

| | | |
|---|---|---|
| DE | 28 18834 | 11/1979 |
| DE | 29 26559 | 1/1981 |
| DE | 35 16202 | 6/1986 |

* cited by examiner

*Primary Examiner*—Michael J. Carone
*Assistant Examiner*—M. Thomson
(74) *Attorney, Agent, or Firm*—Pillsbury Winthrop LLP

(57) ABSTRACT

A firing device for a gun which is used in a target practice and competitive shooting system, said firing device being such, that it activates computer processing of the shot, and said firing device comprising a trigger frame (1), to which a trigger (2) is attached, and a firing mechanism (3,4,5,6,7) connected to the trigger which is used for firing the gun when the trigger is pressed. A firing mechanism formed in accordance with the invention consists of a magnet (3), a safety lock (4), which is moved by the trigger, is located in the proximity of the magnet and which has been designed such that it can be adjusted by the counterforce device (5, 20), a microswitch (6) or a corresponding device to send an impulse to the computer.

10 Claims, 2 Drawing Sheets

DISCHARGING DEVICE

Figure 1:
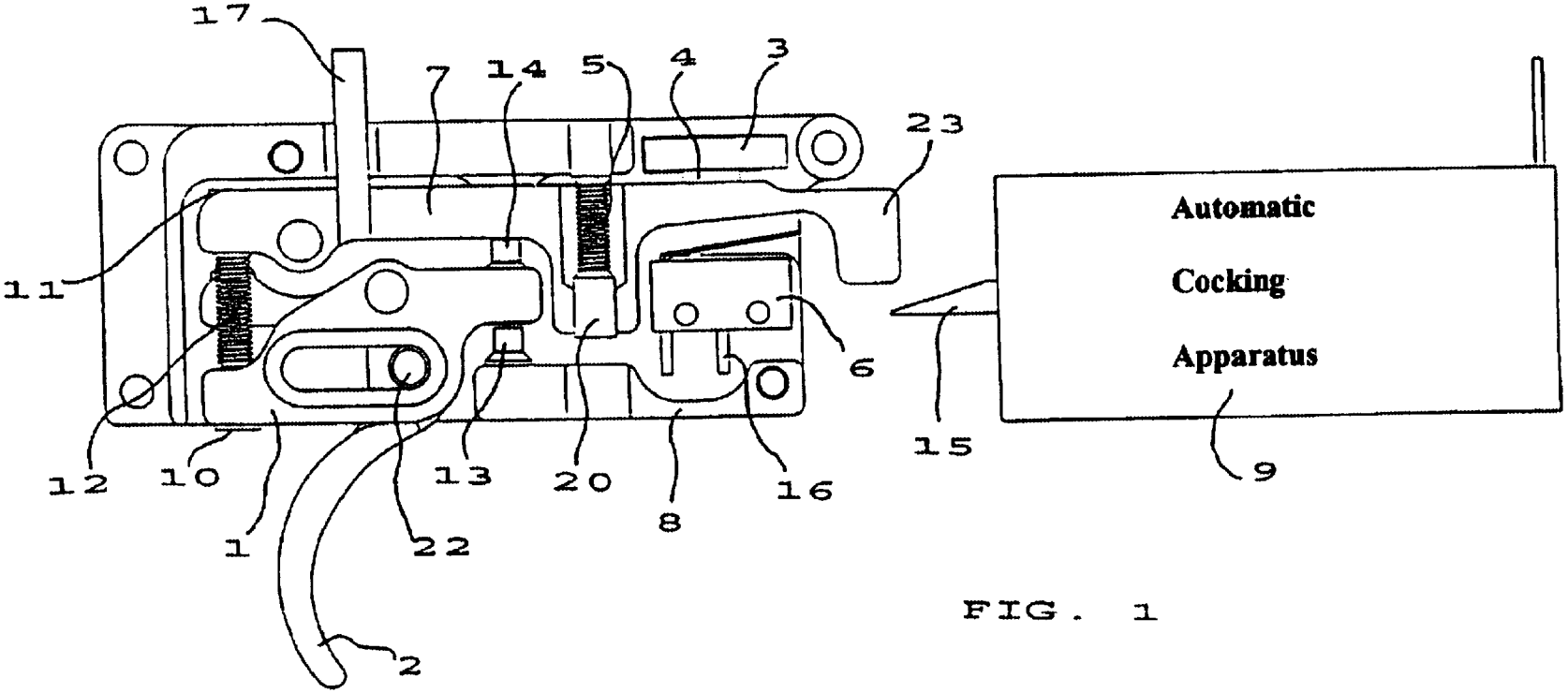

This is a Continuation of National application Ser. No. 09/805,433 filed Mar. 14, 2001 now abandoned, which is continuation of International Application No. PCT/FI99/00766 filed Sep. 17, 1999 which designated the U.S.

The present invention relates to a firing device for a gun, which is used for target practice and competitive shooting, said firing device being such, that it activates computer processing of the shot, and said firing device comprising a trigger frame, to which the trigger is attached, and a firing mechanism connected to the trigger, said firing mechanism being such that it fires the gun when the trigger is pressed.

Guns generally use firing devices which are based on the release of tension created by the sear lever. The tension is spring-loaded. When the trigger is pulled, the firing mechanism cancels out the spring-back factor and also, in some cases, the self-sustaining tension caused by the wedge-shaped form of the sear lever. When the sear lever is released, the trigger lever releases the firing pin, which ignites the detonator, or the air valve or air piston in an air gun. This is what activates the firing process of the gun. Such sear levers wear out from use and maintenance of the firing devices is necessary at certain time intervals.

The object of the invention is to provide a firing device by which the disadvantages associated with current firing devices will be eliminated. In particular, the object of the invention is to provide a firing device, which is simple in its structure, reliable and advantageous in its costs of use and maintenance.

The object of the invention is accomplished with a firing device, the characteristics of which are set forth in the claims.

A firing device formed in accordance with the invention comprises a magnet, a safety lock, which is moved by the trigger, is located near the magnet and is designed to be adjusted by the counterforce device, and a switch or corresponding device, to send an impulse to the computer. In a system of target shooting formed in accordance with the invention, sear levers are not used, instead, after the magnet and safety lock have been engaged, the trigger releases the switch or corresponding device, which activates the computer program that records the information about the shooting. The switch can comprise a microswitch or any other device suitable for the purpose, such as a photocell breaker, capacity transducer, acceleration transducer etc. One advantage of the invention is that these firing devices do not use sear levers, which become worn out and therefore require maintenance. A trigger in a firing device formed in accordance with the invention immediately transfers the impulse through the switch to a computer. A microswitch, or other type of switch, has never previously been used for this purpose. The advantage of a firing device formed in accordance with the invention is therefore the longevity of the firing device. Furthermore, the firing device has all of the necessary regulations which are produced with different regulation mechanisms.

The operation of the firing device is based on a safety lock without a sear lever, regulated by a magnet and counterforce, in which case the device is designed to discharge one shot at a time. Furthermore, the gun can be equipped with a cocking apparatus for the firing system, which is a built-in or an externally mounted accessory, and functions by means of an automatic spring, electricity, hydraulics, air pressure or gas in order to imitate the automatic and semi-automatic gun. Furthermore, a firing device formed in accordance with the invention is versatile, in that it can be altered either to have trigger travel, or not to have trigger travel merely by adjusting some screws, and its trigger can be inclined and moved in a longitudinal direction.

Target practice often consists of several events in which the gun functions automatically or semi-automatically like a submachine gun, assault rifle or semiautomatic pistol.

In an application of the firing device, in which the firing device imitates a sem-automatic, self-loading gun or a revolver-type gun, the firing device can be adjusted so that it always returns to its initial state as the trigger is being released. This can be accomplished, for example, by removing one spring and a screw from the firing device.

Figure 2:
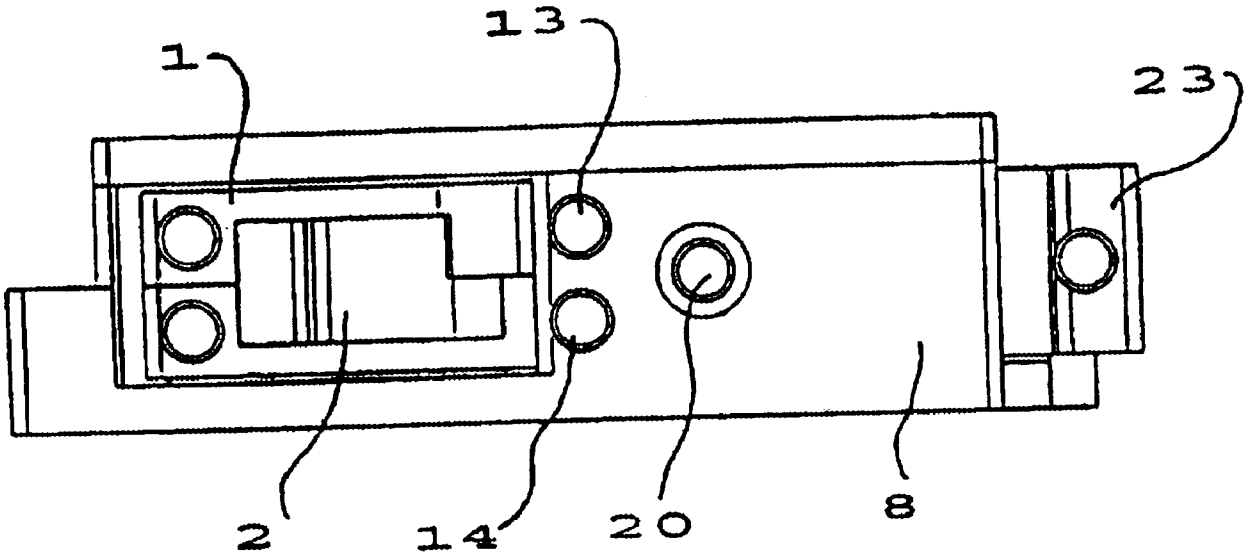

The invention will now be described in more detail with reference to the accompanying drawing in which FIG. 1 illustrates schematically a firing device used in a target practice system as seen from the side, and FIG. 2 illustrates a device formed in accordance with FIG. 1 as seen from underneath without a return system.

The firing device for a gun which is used in a system for target practice and competitive shooting formed in accordance with the figures, consists of a gun frame 8, to which a trigger frame 1 is attached, to which a trigger 2 is attached, and of a firing mechanism 3, 4, 5, 6, 7, which is connected to the trigger and which fires the gun when the trigger is pressed. The firing mechanism consists of a magnet 3, a safety lock 4 such as a countermagnet, which is moved by the trigger and is designed to be adjusted by the counterforce device 5, 20, a microswitch 6 which sends an impulse to the computer and an intermediate lever 7 placed in the proximity of the trigger frame 1 and is attached to the frame of the firing device so that it can be moved. The magnet 3 is located on the firing device or on the gun frame 8 and the countermagnet safety lock 4 is fastened to the intermediate lever 7. In some other application, the magnet can be mounted on the intermediate lever and the safety lock on the gun frame. In this application, the safety lock 4 is a piece of iron or magnet or corresponding piece which can be magnetized so it can be made suitable to act as a magnet mounted on the intermediate lever 7 in the vicinity of the magnet 3. Furthermore, the firing device comprises a trigger pull adjustment screw 10, which is located on the back of the trigger frame 1, more precisely between the trigger frame and the intermediate lever, and a trigger travel adjustment screw 11, as well as a spring 12, all of which help to regulate the trigger weight and travel. In addition, the firing device comprises adjusting screws 13 and 14 placed on the front of the trigger frame. The counterforce spring 5 and the counterforce adjusting screw 20 function as the counterforce device.

In another application of the invention, the firing device does not have a separate frame, but instead the frame of the gun also functions as the frame of the firing device. The firing device can also be made without the intermediate lever or its corresponding trigger cradle if the firing device does not require any trigger travel or length adjustment.

Additionally, the firing device comprises an automatic cocking apparatus 9 for the firing mechanism, which is described in FIG. 1. The cocking apparatus consists of a transfer element 15, which extends as far as the vicinity of the intermediate lever and has been designed to return the intermediate lever to its initial position after the shot.

When the gun has been cocked, a pull of the trigger 2 moves the intermediate lever 7 via the trigger travel adjustment screw 11 located on the back of the trigger frame 1, and the intermediate lever 7 works to release the holding magnet 3 in the frame of the firing device from the counter magnet 4 in the intermediate lever. When the tension grows sufficiently great, the bond between the frame 8 of the firing device and the intermediate lever 7, maintained by the magnets 3 and 4, is suddenly released, and this contact now corresponds to the movement of the sear lever of a firing device of a conventional gun. When released, the intermediate lever 7 presses the microswitch 6, which sends an electric impulse to the computer by means of a connector 16. When the gun has been fired, it can be cocked by returning the lever and the trigger to their initial positions with a lever which affects the center pin 17 or 23.

Alternatively, the cock can be returned automatically immediately after the shot by the force resulting from the magnetic actuator in the application illustrated in the figure. In this application, the return impulse is given by an electric impulse, which is guided by the microswitch 6. The fire rate of an automatic gun can be imitated by using a timer, which, for example, allows for a time of 0.08 seconds between shots for an assault rifle.

The different functions of the firing device can be versatilely regulated by the adjusting screws of the firing device. Regulating is carried out as follows:

The firing force is adjusted by a screw 20, which is attached to the intermediate lever and is partly situated between the intermediate lever and the part on the side of the magnet 3 of the firing device. When the screw is loosened, the counterforce spring 5 inside it will slacken and the firing force increases. Accordingly, when the screw is tightened, the firing force decreases.

The trigger travel adjustment screw 11 is located on the back of the trigger frame on the back-side of the trigger and it extends out from the trigger frame to the intermediate lever. By tightening this screw, the distance of the trigger travel becomes shorter.

The amount of trigger pull is adjusted by means of a screw 10, which is mounted on the back of the trigger frame on the back side of the trigger and it extends out from the trigger frame to the intermediate lever. There is also a spring 12 around it. The pull increases when the screw 10 is tightened, which tightens the spring 12.

The overtravel is regulated by the adjusting screw 13 on the trigger frame, in front of the trigger so that overtravel will be as short as possible. Overtravel gets shorter when the screw is tightened. The distance of the retaining movement of the trigger is regulated with the adjusting screw 14 on the front part of the trigger frame. The return movement of the trigger becomes shorter when the screw is tightened, and longer when the screw is loose.

The screw 22, which is placed in the horizontal slot on the trigger frame, connects the trigger 2. The screw in question can also be used for regulating the longitudinal position and the inclination of the trigger.

Basic Regulations of the Firing Device

Before starting to regulate the firing device, a choice between the shot types, a shot with trigger travel or without trigger travel, must be made. Before the gun is initially adjusted, the tightened screw of the trigger has to be loosened and the trigger moved to its forward position and then the retaining screw of the trigger is tightened.

Shot Without Trigger Travel, i.e. Hunting Shot

The trigger pull adjustment screw 10 and the spring 12 are removed and the trigger travel adjustment screw 11 should be properly loosened, about 1–2 rounds. It is also possible to carry out the adjustment without removing the parts mentioned above, by merely loosening the screws, but adjustments made by means of a screw key require a more sensitive touch. Now the trigger will move a short distance freely. After this, the trigger travel adjustment screw 11 is tightened so that the trigger remains unmoved, and does not move the intermediate lever 7 as it stays in place. If necessary, the overtravel can still be decreased with the screw 13. Finally, the safety lock is adjusted with the adjusting screw 20. According to recommendations, the safety lock for a hunting shot should be about 15–25 N.

Shot with Trigger Travel, i.e. Shot in Competitive Shooting

Trigger travel can be created in two different ways. In the first way, the trigger travel and firing force together create the firing resistance. In that case, the spring touches the holding pin which is attached to the frame of the firing device. Such a firing device does not have a safety screw. In the second case, increasing the trigger travel decreases the firing resistance of the last part of the pull of the trigger. In that case, the counterforce screw is adjusted to the intermediate lever. Accordingly, in this case, there is no holding pin. First, the desired trigger travel type is chosen and the required safety screw or holding pin is mounted in its place. Then trigger travel spring 12 is mounted. It is worthwhile to adjust the trigger travel starting from the long and light trigger travel setting, which can be obtained by loosening the trigger travel spring tension with the screw 10 and by the trigger travel adjustment screw 11. When these measures have been taken, the free movement of the trigger will be controlled appropriately for each case by means of the adjusting screws 14 and 11. Finally, trigger travel is regulated according to type with the screw 10 and the safety resistance with the screw 20. Trigger travel should not surpass 50% of the total firing resistance. Thus, this becomes a question of the personal preference of the person shooting, but the firing device functions in the best way when the portion of the trigger travel resistance is not too high in proportion to the total resistance. The force of the shot with trigger travel can be adjusted by regulating the springs within the range of 2–20 N. At the least, trigger travel can be about 0.5 N.

In an application of the firing device in which the firing device imitates a semi-automatic, self-loading gun or a revolver-type gun, the screw 20 and the spring underneath it are removed from the firing device. In this case, the firing device always returns to its initial state as the trigger is being released.

The invention is not limited to the advantageous application set forth in this patent application. The invention is versatile and its form may vary within the frames of the idea of the invention put forth in the claims.

What is claimed is:

1. A firing device for a gun configured for use in one of target practice and competitive shooting, said firing device being configured to activate processing by a computer of a shot, said firing device comprising:

a gun frame;

a trigger frame movably mounted to the gun frame;

a trigger attached to the trigger frame;

a firing mechanism operatively connected to the trigger, the firing mechanism being used for firing the gun when the trigger is pressed, the firing mechanism comprising a magnet, a safety lock disposed in proximity to the magnet, and a micro switch configured to send a firing impulse to the computer when the trigger is pressed; and a counterforce device that adjusts one of the magnet and the safety lock, wherein the one of the magnet and safety lock moves when the trigger is pressed, and the other of the magnet and the safety lock is attached to the gun frame such that the magnet and the safety lock move relative to each other when the trigger is pressed.

2. A firing device according to claim 1, further comprising an intermediate lever that is movably attached to the gun frame and is disposed in proximity to the trigger frame, the intermediate lever operatively connecting the trigger to the micro switch.

3. A firing device according to claim 2, wherein the magnet is fixedly attached to the gun frame, and the safety lock comprises a piece with magnetic properties that is mounted to the intermediate lever.

4. A firing device according to claim 2, further comprising:

a trigger pull adjustment screw located on the back of the trigger frame between the trigger frame and the intermediate lever to adjust the trigger pull; and a trigger travel adjustment screw and spring to adjust the trigger travel.

5. A firing device according to claim 1, further comprising trigger position adjusting screws placed on the trigger frame to adjust the position of the trigger.

6. A firing device according to claim 5, wherein the trigger position adjusting screws are located on the front of the trigger frame.

7. A firing device according to claim 1, further comprising an automatic cocking apparatus for the firing mechanism.

8. A firing device according to claim 7, wherein the automatic cocking apparatus is located inside the gun frame.

9. A firing device according to claim 7, wherein the automatic cocking apparatus is located on the exterior of the gun frame.

10. A firing device according to claim 1, wherein the operation of the firing device is substantially independent of the mechanical operation of the gun that the firing device is configured to be used in conjunction with.

* * * * *